United States Patent [19]

Pettersson

[11] 4,105,494

[45] Aug. 8, 1978

[54] PROCESS OF GAS-PHASE BLEACHING HIGH CONSISTENCY FINELY DISINTEGRATED PULP

[75] Inventor: Bengt Edvard Pettersson, Sundsvall, Sweden

[73] Assignee: Sunds Aktiebolag, Sundsvall, Sweden

[21] Appl. No.: 681,483

[22] Filed: Apr. 29, 1976

Related U.S. Application Data

[62] Division of Ser. No. 426,437, Dec. 20, 1973.

[30] Foreign Application Priority Data

Jan. 5, 1973 [SE] Sweden ..... 73001471

[51] Int. Cl.[2] ..... D21C 9/10; D21C 7/12; D21C 3/24; D21C 7/00

[52] U.S. Cl. ..... 162/19; 162/49; 162/52; 162/63; 162/65

[58] Field of Search ..... 162/246, 238, 50, 52, 162/17, 63, 19, 65, DIG. 10, 49; 259/154, 168; 68/207, 181 R; 8/111

[56] References Cited

U.S. PATENT DOCUMENTS

| | | | |
|---|---|---|---|
| 2,938,824 | 5/1960 | Richter | 162/52 |
| 3,434,920 | 3/1969 | Green | 162/246 X |
| 3,519,532 | 7/1970 | Sutherland | 162/52 |
| 3,579,421 | 5/1971 | Richter | 162/246 X |
| 3,586,600 | 6/1971 | Rich et al. | 162/246 X |
| 3,660,225 | 5/1972 | Verreyne et al. | 162/65 |
| 3,703,435 | 11/1972 | Schleinofer | 162/65 |

FOREIGN PATENT DOCUMENTS 2,135,217 1/1972 Fed. Rep. of Germany ..... 162/65

OTHER PUBLICATIONS

Engstrom et al., "Advances for Oxygen Bleaching, II" Tappi, Nov. 1971, vol. 54, No. 11.

Fox; "Control Strategy" Tappi, May 1966, vol. 49, No. 5.

Morrison, "Changes in Kraft Continuous Digester Instrumentation," Paper Trade Journal; Sept. 14, 1964, pp. 47–51.

*Primary Examiner*—Richard V. Fisher
*Assistant Examiner*—Steve Alvo
*Attorney, Agent, or Firm*—Burns, Doane, Swecker & Mathis

[57] ABSTRACT

An improved process for gas-phase bleaching of cellulose pulp at high pulp consistency including in series a gas zone space beneath said gas zone for a column of fibrous material, a mixing zone and a dilution zone, wherein a hub body is located centrally at the bottom of the tower and provided with driving means for rotation of the shaft bearing the hub body, and the torque required for rotating the hub body is continuously measured. The rate of dilution liquid is varied inversely with variation in torque thereby maintaining substantially constant the consistency of the diluted fibrous material as withdrawn from the bottom of the tower. The height of the pulp column is measured and kept constant by controlling the withdrawal of diluted fibrous material.

3 Claims, 4 Drawing Figures

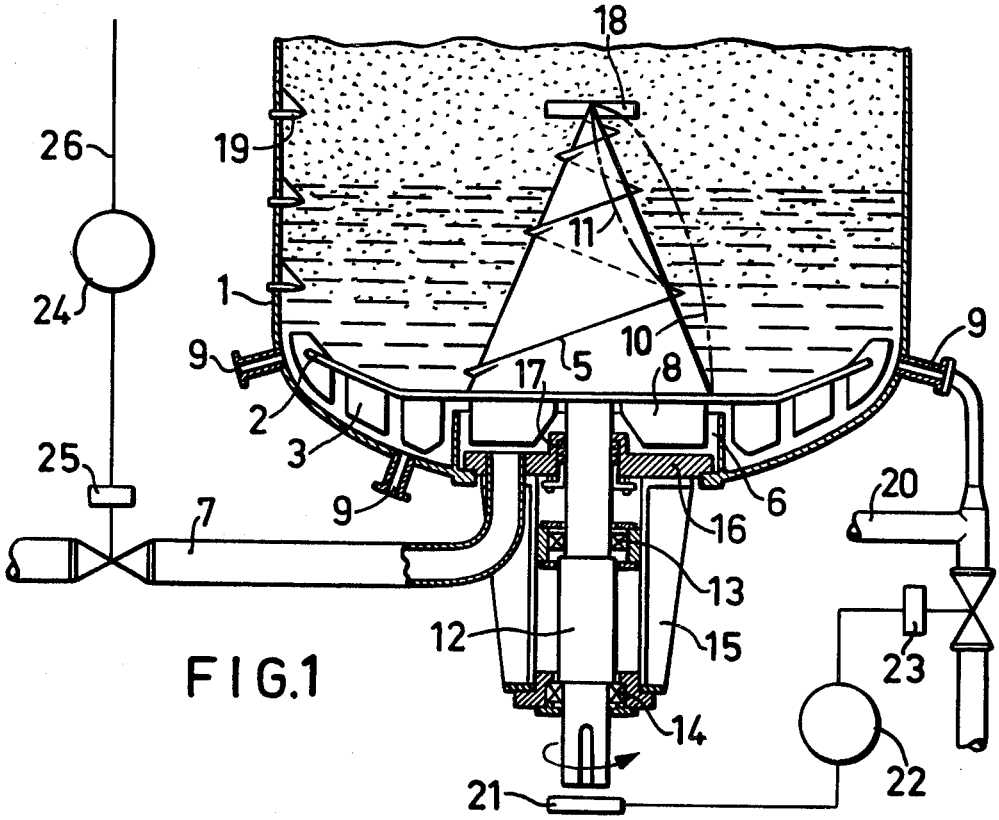
FIG.1
FIG.2
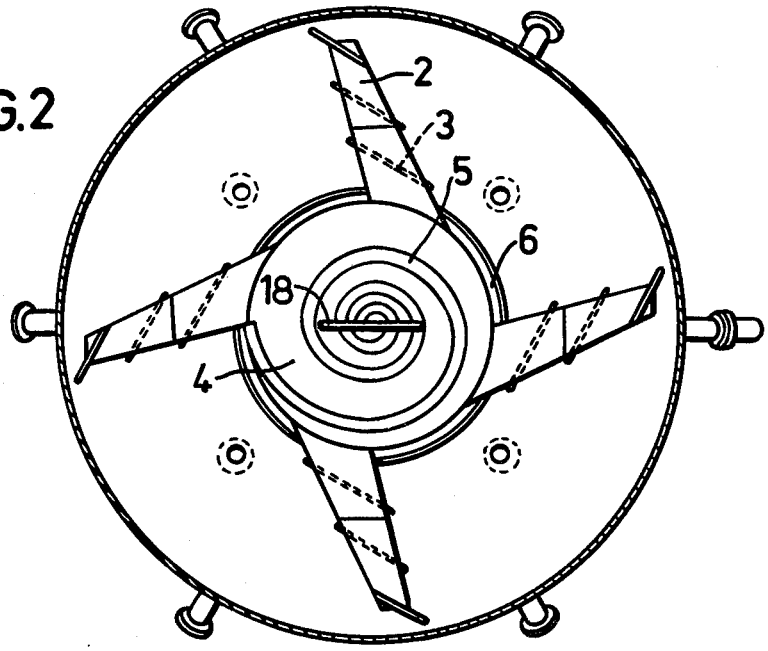

PROCESS OF GAS-PHASE BLEACHING HIGH CONSISTENCY FINELY DISINTEGRATED PULP

This is a division of application Ser. No. 426,437 filed Dec. 20, 1973.

In certain processes where fibrous material such as cellulose pulp is treated at high consistency gas phase bleaching in continuously working devices particular problems can arise. It is known that pulp can be delignified at a high pulp consistency in a down flow pressure vessel. It is important to design the discharging system in such a way that a uniform feeding over the cross section is obtained in order to avoid uneven downward flow and clogging and that excessive gas loss is prevented when the pulp is leaving the treatment vessel.

As regards the last mentioned condition it is to be said that the reason why the treatment with gas is made at a high pulp consistency — 18 to 40%, usually 25 to 35% in a fluffed pulp column, is to create best possible conditions for the gas to reach the separate fibres. On the other side, before discharging the pulp, it is desirable to separate fibres and gas as far as possible. One method is to dilute the pulp with water or waste water to a low consistency in the lower section of the tower. By arranging the discharge opening in the dilution zone, i.e. beneath the level of the diluted suspension, the gas losses can be reduced by obtaining a liquid seal. Thus the gaseous bleaching agent cannot pass through the pulp directly to the outlet pipe which is communicating with the atmosphere. The gas losses are ruled by the dissolving capacity of the gas in the liquid, the intensity of a possible stirring in the dilution zone and the accompanying intermixing of gas bubbles which stick to the fibre netting.

A method for discharge is to arrange the vessel so that the fluffy pulp with high consistency rests directly on a stirred zone with a low pulp consistency — 1 to 12%, usually 3 to 10%. The acitve space where the bleaching occurs is limited downwards by a consistency gradient space between the zones of high and low pulp consistency. Consequently in order to adjust the reaction time it is essential that the vertical extention of the dilution zone can be controlled and that the height of the pulp column of high consistency can be controlled. Practical tests in; among others, a continuously working pilot plant have shown that the dilution liquid which is supplied at the bottom has a tendency to be absorbed by the pulp so that the above mentioned consistency gradient space assumes a considerable extention in the vertical direction. In other words the consistency gradient is reduced, which limits the possibility to maintain a great difference in consistency between the reaction zone and the dilution zone. The lower the consistency maintained in the bottom the higher the consistency gradient space extends in the pulp column.

A comparison can be made with storage towers for pulp with lower consistencies — in the area 10–15%. In this consistency area the pulp is usually substantially incompressible and free from air. By dilution with liquor in the bottom zone of the tower the pulp is pressed away — is lifted — and with an appropriate stirring the desired consistency can be obtained in the bottom zone. The present invention relates to a device for solving the above mentioned problems in bleaching of fibreous material in a bleaching tower where the main part of the pulp has a high consistency (18 - 40%) and which, unlike more or less digested chips in a cellulose digester, is well fluffed.

The characteristics of the invention are defined by the claims.

FIG. 1 illustrates in a vertical section the lower portion of a bleaching tower according to the invention.

FIG. 2 illustrates in a cross section the bleaching tower seen from above.

Figure 3:
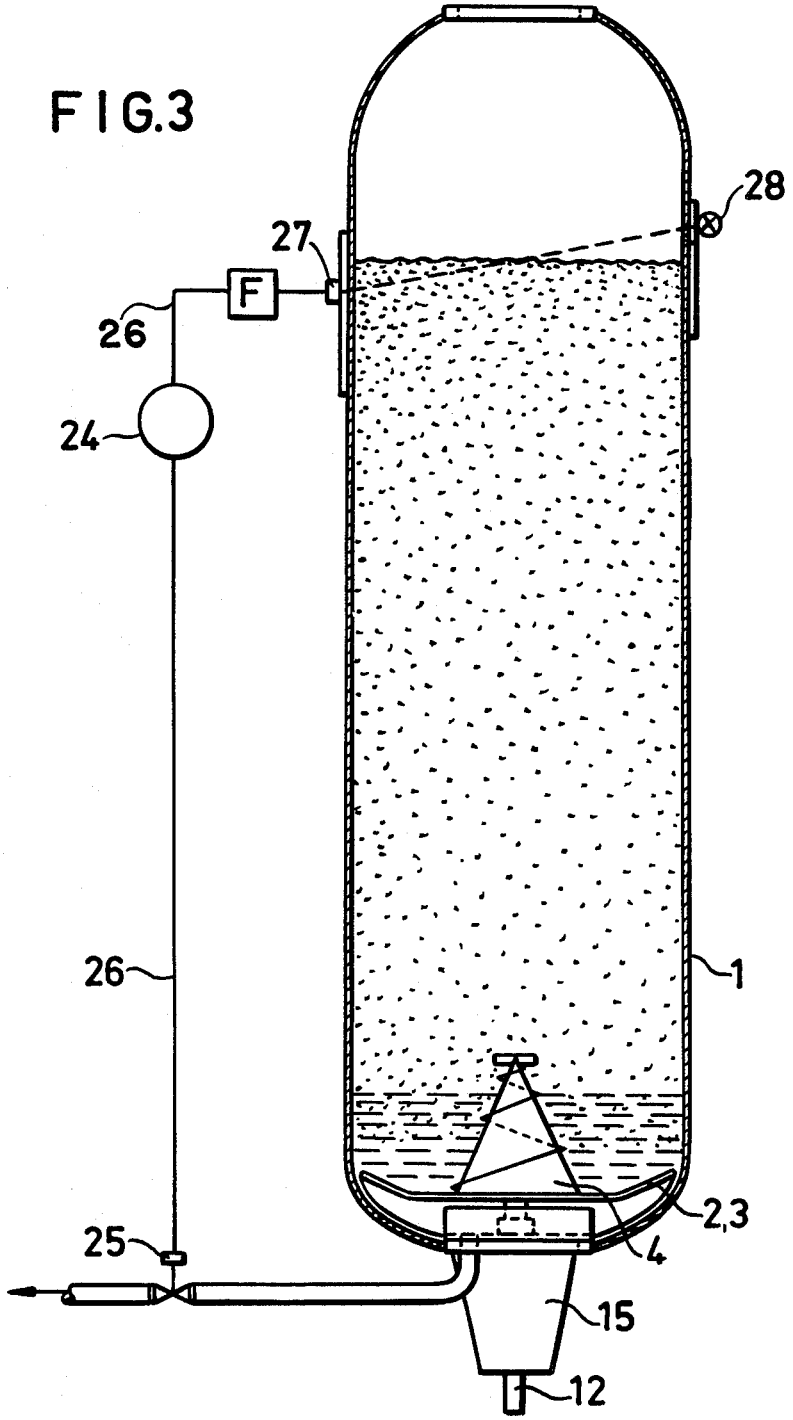
FIG. 3 illustrates a vertical section through the entire bleaching tower.

The device according to the invention will now be described with reference to the species shown in the drawing.

The device for discharging the pulp from the bleaching tower 1 consists of at least two substantially radially extending arms 2 and stirring and conveying means 3, 8 in the shape of vertical blades fixed on said arms. The arms are fixed on a hub body 4 which has an upwardly decreasing shape and is located in the center of the bottom of the vertical tower, which tower is cylindrical or downwardly somewhat enlarged. The hub body 4 suitably is cone-shaped but may alternatively have the shape of a solid of revolution generated by a curved generatrix, as indicated with dotted lines 10, 11 in FIG. 1. It is also possible to form the hub body with a cross section in the shape of a polygon. The hub body 4 is furnished with guiding bars 5 arranged in screw-shape. The base diameter of the hub body is at least a fifth (a fourth, a third, possibly the half or more) of the bottom diameter of the tower and its height is at least approximately as great as said base diameter. At the base of the hub body there is a ring-shaped duct 6 to which the outlet or blow pipe 7 is connected. The stirring and conveying means 8 which are located close to the hub body extend into the duct 6. Inlets 9 for diluting liquid are placed at the ring shaped duct as well as at the periphery of the tower close to the bottom. If required dilution liquid is also supplied to the duct 6.

The hub body 4 is carried by a drive shaft 12, which is mounted in a casing 15 by means of bearings 13 and 14. The casing is fixed on a central plate. For tightening around the shaft a packing box 17 is arranged. The shaft 12 is intended for rotating in the direction of the arrow. The guiding bars 5 are arranged for feeding the pulp downwards and cause, at the rotation the hub body 4 an additional moment to the torque required for driving of the hub body. If the pitch angle is made sufficiently large the feeding effect becomes small and instead the stirring effect increases as well as the torque required. The guiding bars 5 might be eliminated if other means for causing additional moments are arranged, e.g. plates 18. Such means, which also result in stirring, can be arranged at suitable points on the surface of the hub body, however preferably at its top.

The stirring and conveying means 3 assist in guiding the pulp in the dilution zone towards the ring-shaped duct 6 and/or produce the stirring desired. If the means 3 are adjusted for feeding outwards (contrary to what is shown in FIG. 2) the stirring effect is increased, which may be favourable at a considerable dilution in the dilution zone. As mentioned the number of arms 2 ought to be at least two. A suitable number is three to five. By larger tower diameters still more arms may be required even if four normally are sufficient.

The inlets 9 for dilution liquid are connected to a main conduit via connection conduits 20. Said inlets may be disposed only at the periphery of the tower and/or at the bottom of the tower.

The hub body 4 with the arms 2 rotates with a speed of 0.5 – 10 rpm preferably 1 –6 rpm. The dilution liquid is added through the inlets 9 and the pulp suspension is discharged through the outlet 7 at a consistency moment of 1 –12%, usually 3 –10%.

The hub body 4 can be extended through the consistency gradient space so that the pulp column of high consistency is partly supported by said body. However, it may be sufficient if the hub body to some extent extends into the consistency gradient space.

Figure 4:
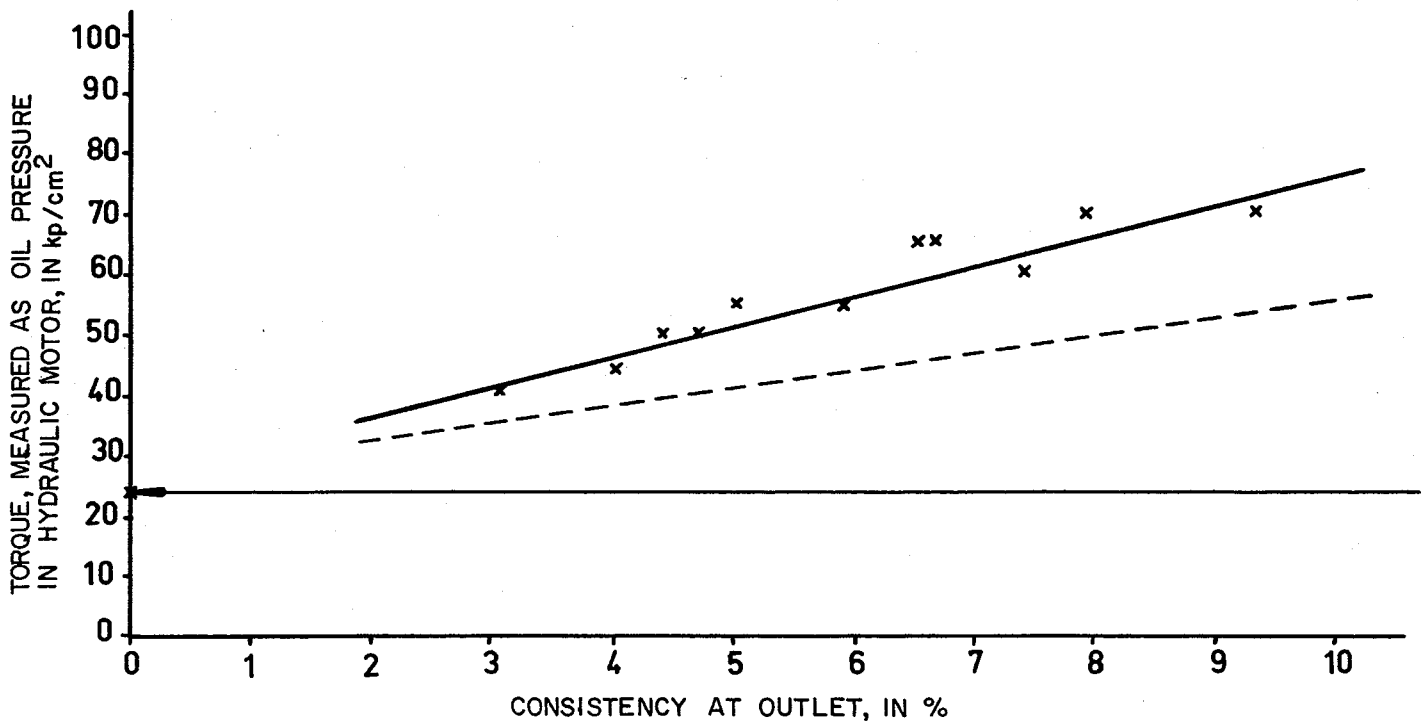
FIG. 4 illustrates in an applied case the relation between required torque for a hub body arranged at the bottom of the tower and the consistency of the fibreous material in the outlet.

The torque required for rotating the hub body varies depending on how large a part of the hub body is situated above the dilution zone. The larger the part above the dilution zone the higher the torque required. By continuous impulses from a torque transmitter 21, which measures the torque, a regulator 22 is actuated. Said regulator 22 controls a valve 23 for the dilution inversely to the measured torque so that the torque is kept constant and intended pulp consistency at the outlet is maintained. FIG. 4 shows the relation between the torque and the pulp consistency at the outlet. The figures are measured in pilot plant operation. The figures refer to operation by a hydraulic motor and the oil pressure required is in principle directly proportional to the torque required.

The oil pressure required for the hydraulic motor intended for rotation of the hub body 4 in the bleaching tower, when it contains only water, i.e. 0% pulp consistency, is marked with a horizontal line. In order to adjust the height of the dilution zone with a satisfactory accuracy, the torque (oil pressure) required besides the torque (oil pressure) at idle running ought to be doubled (dotted line in FIG. 4) and suitably at least multiplied by four (continuous line in FIG. 4) if the consistency in the dilution zone increases from 2% to 10%.

Owing to the supporting function of the hub body the location of the consistency gradient space is relatively independent of the consistency in the dilution zone.

By the rotation of the hub body 4 the pulp and liquid are mixed and at the same time a feeding movement in the pulp suspension towards the outlet is obtained. The screw-shaped guiding bars 5, besides causing an additional moment, are adapted to give a uniform downward flow of the pulp over the cross section of the tower.

As a complement to indication of the torque, differences in temperature in the bottom zone can be registered or used for automatically controlling the amount of dilution liquid.

FIG. 1 shows three temperature indicators (19) one of which is placed in the reaction space, one in the dilution space and one in the consistency gradient space. If oxygen is used as bleaching agent a temperature of 100° – 120° C. in the reaction zone is suitable and in the dilution zone the temperature normally reaches 40° – 90° C.

In gas phase bleaching a gas filled space is usually maintained in the upper portion of the tower over a pulp column of high consistency. In order to obtain a uniform bleaching with the intended bleaching degree the height of the pulp column ought to be kept constant. In connection with the discharging device mentioned above, a radioactive measuring method can be used for the height of the pulp column. At or on a level with the upper surface of the pulp column of high consistency a radioactive source 28 is adjustably arranged at the outside of the tower. Diametrically opposed at the outside of the tower a receiver 27 is adjustably arranged, suitably a Geiger-Müller tube. The radiation from the radioactive source 28 is indicated by the receiver 27. The radiation has a certain strength if it passes through the gas filled space. If the radiation passes through the pulp column the radiation which reaches the receiver gets weaker or none at all. The radiation is converted by the receiver 27 into electric current which is conducted by a conduit 26 to a regulator 24 via an amplifier F. The regulator 24 controls a discharge valve 25 in the blow pipe 7. Since the measuring equipment is vertically adjustable, a suitable height of the pulp column can be chosen. s

I claim:

1. In a continuous process for gas-phase bleaching, at high consistency, of finely disintegrated gas-pervious fibrous material, which comprises establishing and maintaining a generally vertical column of fibrous material of a high consistency of from about 18 to about 40%, in an elongated generally vertical chamber, said column of high consistency being spaced from the upper and lower extremities of the chamber wherein there is a gas space with an atmosphere containing gaseous bleaching agent above, and a dilution space beneath, between said column and said dilution space there being a consistency gradient space;

continuously showering fluffed finely disintegrated fibrous material into the chamber at the upper end thereof through said atmosphere containing gaseous bleaching agent and onto the top of said column while simultaneously maintaining substantially constant the height of said column by continuously removing fibrous material from the lower end of said column through said consistency gradient space and into said dilution space;

continuously introducing dilution liquid into said dilution space to establish and maintain therein a body of diluted fibrous material;

the fibrous material during its continuous removal from the lower end of said column being guided downwardly and outwardly by rotating a rotatable hub body extending from adjacent the bottom of the tower upwardly through said dilution space and into said consistency gradient space, said hub body having a progressively greater cross-sectional area from top to bottom thereof;

maintaining substantially constant the torque required for rotating said hub body by substantially continuously measuring the actual variations from a predetermined normal torque and varying the rate of introduction of dilution liquid inversely with variation in said torque, thereby maintaining substantially constant the consistency of the diluted fibrous material as withdrawn from the bottom of the tower; and continuously measuring the height of the column, and varying the rate of withdrawal of diluted fibrous material from the bottom of the tower so as to maintain substantially constant the height of said column.

2. Process as defined in claim 1, wherein the diameter of said hub body at its lower end is such that the cross-sectional area of said space at the base of said hub body is limited inwards by a circle having a diameter which is at least a fifth the diameter of the tower.

3. Process as defined in claim 1, in which oxygen is the gaseous bleaching agent and in which the temperature in the gaseous atmosphere is maintained within the ranges 100°–120° C. and the temperature in the dilution zone is maintained between 40° and 90° C.

* * * * *